US009333771B2

(12) United States Patent
Mizuno

(10) Patent No.: US 9,333,771 B2
(45) Date of Patent: May 10, 2016

(54) IMAGE RECORDING APPARATUS, METHOD OF CONTROLLING THE SAME, AND NON-TRANSITORY STORAGE MEDIUM STORING INSTRUCTIONS EXECUTABLE BY THE IMAGE RECORDING APPARATUS

(71) Applicant: BROTHER KOGYO KABUSHIKI KAISHA, Nagoya-shi, Aichi-ken (JP)

(72) Inventor: Toru Mizuno, Kasugai (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/801,313

(22) Filed: Jul. 16, 2015

(65) Prior Publication Data

US 2016/0016419 A1 Jan. 21, 2016

(30) Foreign Application Priority Data

Jul. 17, 2014 (JP) ..... 2014-147180

(51) Int. Cl.

| | |
|---|---|
| ***B41J 11/42*** | (2006.01) |
| ***B41J 13/00*** | (2006.01) |
| ***B41J 11/00*** | (2006.01) |

(52) U.S. Cl.

CPC ..... *B41J 13/0009* (2013.01); *B41J 11/00* (2013.01); *B41J 13/0018* (2013.01)

(58) Field of Classification Search

CPC ..... B41J 11/00; B41J 13/009; B41J 3/0018
See application file for complete search history.

(56) References Cited

U.S. PATENT DOCUMENTS

| | | | |
|---|---|---|---|
| 5,672,019 | A | 9/1997 | Hiramatsu et al. |
| 5,755,435 | A | 5/1998 | Fujiwara |
| 6,485,011 | B1 | 11/2002 | Yen et al. |
| 6,702,274 | B1 | 3/2004 | Otsuka |
| 6,791,725 | B1 | 9/2004 | Ohtani |

(Continued)

FOREIGN PATENT DOCUMENTS

| | | |
|---|---|---|
| CN | 1089566 A | 7/1994 |
| EP | 2 095 967 A1 | 9/2009 |

(Continued)

OTHER PUBLICATIONS

Office Action issued in related Chinese Application No. 201310099593.7, mailed Jan. 13, 2015. (14 pages).

(Continued)

*Primary Examiner* — Julian Huffman
(74) *Attorney, Agent, or Firm* — Merchant & Gould P.C.

(57) ABSTRACT

An image recording apparatus executes: rotating a motor to cause a supply roller to supply a sheet; a conveyance processing for rotating the motor to cause a conveying roller and/or an output roller to convey the sheet; a recording processing for controlling a recording head to perform image recording while the conveyance processing is not executed; controlling the recording head and the motor to perform an image recording operation by executing the conveyance processing and the recording processing alternately; and a pre-discharge supply processing in the image recording operation at a time after a timing when a trailing edge position of a first sheet passes through the conveying roller and before all the recording processings on the first sheet are completed. The supply roller supplies a second sheet in the pre-discharge supply processing to the conveyance path, following the first sheet.

13 Claims, 9 Drawing Sheets

(56) References Cited

U.S. PATENT DOCUMENTS

| | | | | |
|---|---|---|---|---|
| 6,811,151 | B2 | 11/2004 | Wei-Feng et al. | |
| 7,172,190 | B2 | 2/2007 | Park | |
| 7,562,870 | B2 | 7/2009 | Terada | |
| 7,934,717 | B2 | 5/2011 | Takeda et al. | |
| 8,152,161 | B2 | 4/2012 | Samoto et al. | |
| 8,915,494 | B2 | 12/2014 | Samoto et al. | |
| 2001/0033389 | A1 | 10/2001 | Kurihara | |
| 2004/0032074 | A1 | 2/2004 | Park | |
| 2004/0041869 | A1 | 3/2004 | Horiuchi et al. | |
| 2005/0052484 | A1 | 3/2005 | Horiuchi | |
| 2007/0076036 | A1 | 4/2007 | Koga et al. | |
| 2008/0150993 | A1 | 6/2008 | Maki | |
| 2009/0009777 | A1* | 1/2009 | Miyashita | B41J 13/0018 358/1.5 |
| 2009/0057981 | A1 | 3/2009 | Fukasawa et al. | |
| 2009/0218758 | A1 | 9/2009 | Sano et al. | |
| 2011/0050780 | A1 | 3/2011 | Mizutani et al. | |
| 2013/0256976 | A1 | 10/2013 | Samoto et al. | |
| 2013/0278664 | A1* | 10/2013 | Arakane | B41J 23/04 347/16 |
| 2015/0166279 | A1 | 6/2015 | Samoto et al. | |

FOREIGN PATENT DOCUMENTS

| | | | |
|---|---|---|---|
| JP | 6-263274 | A | 9/1994 |
| JP | 9-124207 | A | 5/1997 |
| JP | 10-329974 | A | 12/1998 |
| JP | 2000-095379 | A | 4/2000 |
| JP | 2000-127368 | A | 5/2000 |
| JP | 2000-127570 | A | 5/2000 |
| JP | 2001-039552 | A | 2/2001 |
| JP | 2001-301282 | A | 10/2001 |
| JP | 2003-094754 | A | 4/2003 |
| JP | 2004-082640 | A | 3/2004 |
| JP | 2004-268382 | A | 9/2004 |
| JP | 2005-096450 | A | 4/2005 |
| JP | 2006-240076 | A | 9/2006 |
| JP | 2006-256080 | A | 9/2006 |
| JP | 2006-264308 | A | 10/2006 |
| JP | 2007-090800 | A | 4/2007 |
| JP | 2007-217179 | A | 8/2007 |
| JP | 2009-012922 | A | 1/2009 |
| JP | 2009-034824 | A | 2/2009 |
| JP | 2009-056728 | A | 3/2009 |
| JP | 2009-233901 | A | 10/2009 |
| JP | 2010-167791 | A | 8/2010 |
| JP | 2013-203503 | A | 10/2013 |

OTHER PUBLICATIONS

Office Action issued in related U.S. Appl. No. 14/546,852, mailed Jun. 5, 2015. (10 pages).

Notice of Allowance issued in related U.S. Appl. No. 13/851,774, mailed Aug. 18, 2014. (11 pages).

Office Action issued in related U.S. Appl. No. 13/851,774, mailed May 7, 2014. (6 pages).

Office Action issued in related U.S. Appl. No. 13/851,774, mailed Nov. 5, 2013. (8 pages).

U.S. Office Action issued in related U.S. Appl. No. 14/546,852, mailed Dec. 10, 2015.

* cited by examiner

IMAGE RECORDING APPARATUS, METHOD OF CONTROLLING THE SAME, AND NON-TRANSITORY STORAGE MEDIUM STORING INSTRUCTIONS EXECUTABLE BY THE IMAGE RECORDING APPARATUS

CROSS REFERENCE TO RELATED APPLICATION

The present application claims priority from Japanese Patent Application No. 2014-147180, which was filed on Jul. 17, 2014, the disclosure of which is herein incorporated by reference in its entirety.

BACKGROUND

1. Technical Field

The following disclosure relates to an image recording apparatus configured to record an image on a sheet, a method of controlling the image recording apparatus, and a non-transitory storage medium storing a plurality of instructions executable by a computer of the image recording apparatus.

2. Description of the Related Art

There is known an image recording apparatus capable of recording an image on a sheet. One example of such an image recording apparatus includes: a supply roller configured to supply a sheet to a conveyance path; a conveying roller and an output roller configured to convey the sheet supplied from the supply roller; and a motor configured to transmit power to these rollers for rotation thereof. Forward rotation of the motor does not rotate the supply roller but rotates the conveying roller and the output roller in a rotational direction in which to convey the sheet in a conveying direction. Reverse rotation of the motor rotates the supply roller in a rotational direction in which to supply the sheet to the conveyance path, rotates the conveying roller in a rotational direction in which to convey the sheet in a direction reverse to the conveying direction, and does not rotate the output roller. In the case where image recording is performed on a plurality of sheets successively in this image recording apparatus, a sheet on which the image recording has been performed is discharged, and the next sheet is thereafter supplied to the conveyance path.

SUMMARY

In one aspect of the disclosure, an image recording apparatus includes: a supply roller configured to supply a sheet to a conveyance path; a conveying roller rotatable forwardly to convey the sheet supplied by the supply roller in a conveying direction and the conveying roller being rotatable reversely; an output roller rotatable forwardly to convey the sheet conveyed by the conveying roller in the conveying direction; a carriage provided with a recording head configured to perform image recording on the sheet, the carriage being disposed between the conveying roller and the output roller in the conveying direction and configured to be moved in a moving direction intersecting the conveying direction; a motor rotatable in a first rotational direction and in a second rotational direction reverse to the first rotational direction; a transmission mechanism configured to: cause driving power generated by the motor during rotation thereof in the first rotational direction, to be transmitted not to the supply roller, transmitted to the conveying roller to rotate the conveying roller forwardly, and transmitted to the output roller to rotate the output roller forwardly; and cause driving power generated by the motor during rotation thereof in the second rotational direction, to be transmitted to the supply roller to rotate the supply roller, transmitted to the conveying roller to rotate the conveying roller reversely, and transmitted not to the output roller; and a controller configured to execute: a supply processing in which the controller controls the motor to rotate in the second rotational direction to cause the supply roller to supply the sheet; a conveyance processing in which the controller controls the motor to rotate in the first rotational direction to cause at least one of the conveying roller and the output roller to convey the sheet in the conveying direction; a recording processing in which the controller controls the carriage to move in the moving direction and controls the recording head to perform the image recording during moving the carriage, while the conveyance processing is not being executed; controlling the carriage, the recording head, and the motor to perform an image recording operation by executing the conveyance processing and the recording processing alternately; and a pre-discharge supply processing as the supply processing in the image recording operation at a point in time in a period starting from a timing when a trailing edge position of a first sheet passes through the conveying roller and ending at a timing when all the recording processings on the first sheet are completed, the controller being configured to, in the pre-discharge supply processing, control the supply roller to supply a second sheet to the conveyance path, following the first sheet being stopped from being conveyed, in a state in which the trailing edge of the first sheet is positioned between the conveying roller and the output roller in the conveying direction, in the conveyance processing.

Another aspect of the disclosure provides a method of controlling an image recording apparatus. The image recording apparatus includes: a motor rotatable in a first rotational direction and in a second rotational direction reverse to the first rotational direction; a supply roller configured not to supply the sheet by rotation of the motor in the first rotational direction and configured to supply the sheet by rotation of the motor in the second rotational direction; a conveying roller rotatable forwardly by the rotation of the motor in the first rotational direction to convey the sheet in a conveying direction and rotatable reversely by the rotation of the motor in the second rotational direction; an output roller rotatble forwardly by the rotation of the motor in the first rotational direction to convey the sheet in the conveying direction and configured not to convey the sheet in the conveying direction by the rotation of the motor in the second rotational direction; and a carriage provided with a recording head configured to perform image recording on the sheet. The carriage is disposed between the conveying roller and the output roller in the conveying direction and configured to be moved in a moving direction intersecting the conveying direction. The method includes: a supply processing for controlling the motor to rotate in the second rotational direction to cause the supply roller to supply the sheet; a conveyance processing for controlling the motor to rotate in the first rotational direction to cause at least one of the conveying roller and the output roller to convey the sheet in the conveying direction; a recording processing for controlling the carriage to move in the moving direction and controlling the recording head to perform the image recording during moving the carriage, while the conveyance processing is not being executed; controlling the carriage, the recording head, and the motor to perform an image recording operation by executing the conveyance processing and the recording processing alternately; and a pre-discharge supply processing as the supply processing in the image recording operation at a point in time in a period starting from a timing when a trailing edge position of a first sheet passes through the conveying roller and ending at a timing when all the recording processings on the first sheet are completed. In the pre-discharge supply processing, the supply roller is controlled to supply a second sheet to the conveyance path, following the first sheet being stopped from being conveyed, in a state in which the trailing edge of the first sheet is positioned between the conveying roller and the output roller in the conveying direction, in the conveyance processing.

Another aspect of the disclosure provides a non-transitory storage medium storing a plurality of instructions executable by a computer of an image recording apparatus. The image recording apparatus includes: a motor rotatable in a first rotational direction and in a second rotational direction reverse to the first rotational direction; a supply roller configured not to supply the sheet by rotation of the motor in the first rotational direction and configured to supply the sheet by rotation of the motor in the second rotational direction; a conveying roller rotatable forwardly by the rotation of the motor in the first rotational direction to convey the sheet in a conveying direction and rotatable reversely by the rotation of the motor in the second rotational direction; an output roller rotatble forwardly by the rotation of the motor in the first rotational direction to convey the sheet in the conveying direction and configured not to convey the sheet in the conveying direction by the rotation of the motor in the second rotational direction; and a carriage provided with a recording head configured to perform image recording on the sheet. The carriage being disposed between the conveying roller and the output roller in the conveying direction and configured to be moved in a moving direction intersecting the conveying direction. The plurality of instructions, when executed, cause the computer to execute: a supply processing for controlling the motor to rotate in the second rotational direction to cause the supply roller to supply the sheet; a conveyance processing for controlling the motor to rotate in the first rotational direction to cause at least one of the conveying roller and the output roller to convey the sheet in the conveying direction; a recording processing for controlling the carriage to move in the moving direction and controlling the recording head to perform the image recording during moving the carriage, while the conveyance processing is not being executed; controlling the carriage, the recording head, and the motor to perform an image recording operation by executing the conveyance processing and the recording processing alternately; and a pre-discharge supply processing as the supply processing in the image recording operation at a point in time in a period starting from a timing when a trailing edge position of a first sheet passes through the conveying roller and ending at a timing when all the recording processings on the first sheet are completed, the pre-discharge supply processing being for controlling the supply roller to supply a second sheet to the conveyance path, following the first sheet being, in a state in which the trailing edge of the first sheet is positioned between the conveying roller and the output roller in the conveying direction, stopped from being conveyed in the conveyance processing.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Hereinafter, there will be described one embodiment by reference to the drawings. It is to be understood that the following embodiment is described only by way of example, and the disclosure may be otherwise embodied with various modifications without departing from the scope and spirit of the disclosure. A multi-function peripheral (MFP) 10 is used in a state illustrated in FIG. 1. In the present embodiment, an up and down direction 7 is defined as an up and down direction of the MFP 10 illustrated in FIG. 1, i.e., the MFP 10 being in a normal state. A front and rear direction 8 is defined by regarding a side of the MFP 10 on which an opening 13 is formed as a front side, and a right and left direction 9 is defined in a state in which the MFP 10 is seen from the front side.

Overall Structure of MFP 10

Figure 1:
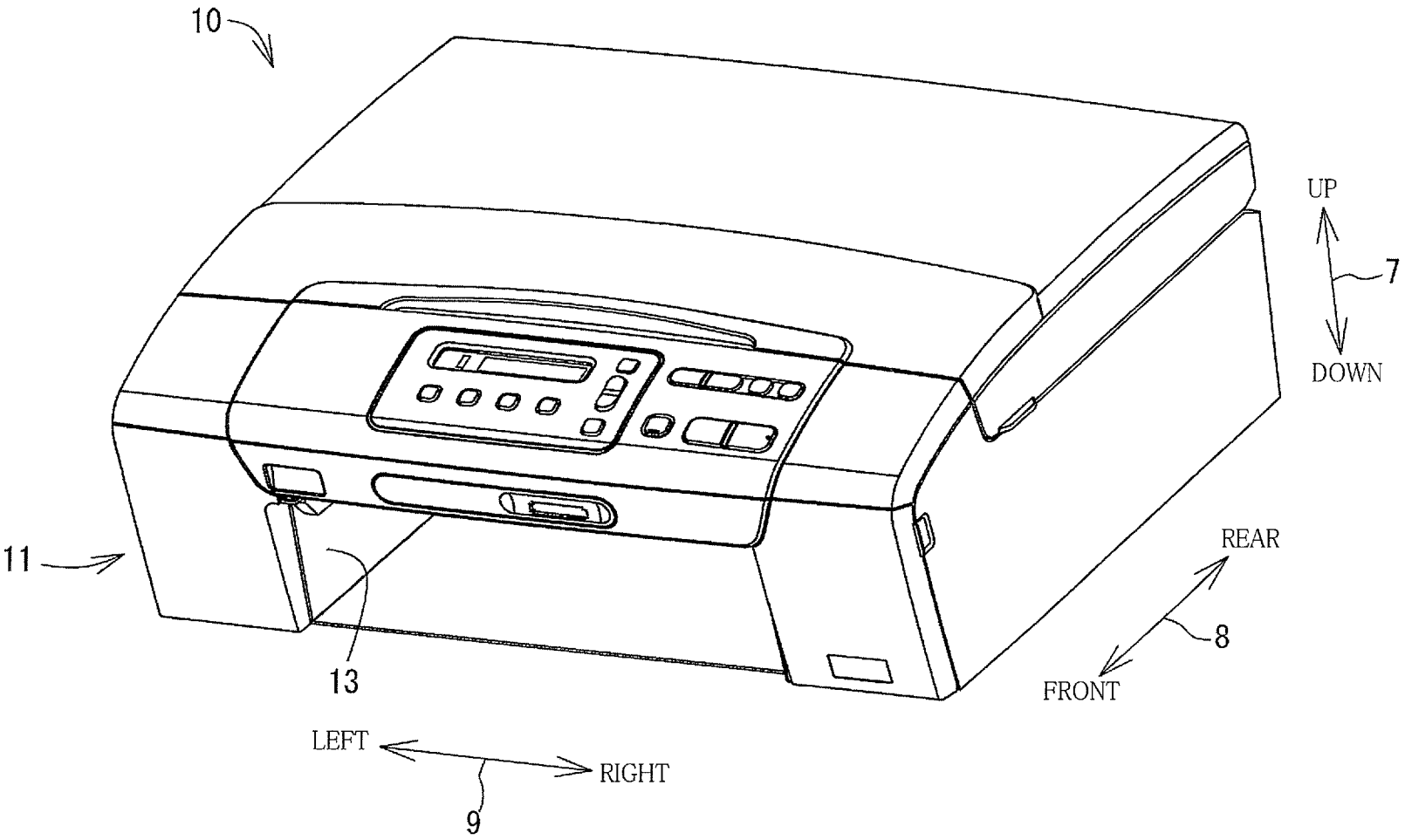
FIG. 1 is a perspective view illustrating a multi-function peripheral (MFP)

As illustrated in FIG. 1, the MFP 10 as one example of an image recording apparatus includes a printing unit 11 at its lower portion. The MFP 10 has various functions such as a facsimile function and a printing function. The printing function includes a duplex image recording function for recording images on front and back surfaces of a sheet 12 (see FIG. 2). The printing unit 11 has the opening 13 in its front face. The MFP 10 includes a supply tray 20 (see FIG. 2) and an output tray 21 (see FIG. 2) each capable of supporting the sheets 12. These trays 21, 22 can be inserted and removed through the opening 13 in the front and rear direction 8. It is noted that the MFP 10 may perform image recording on any recording medium other than the sheet 12.

Figure 2:
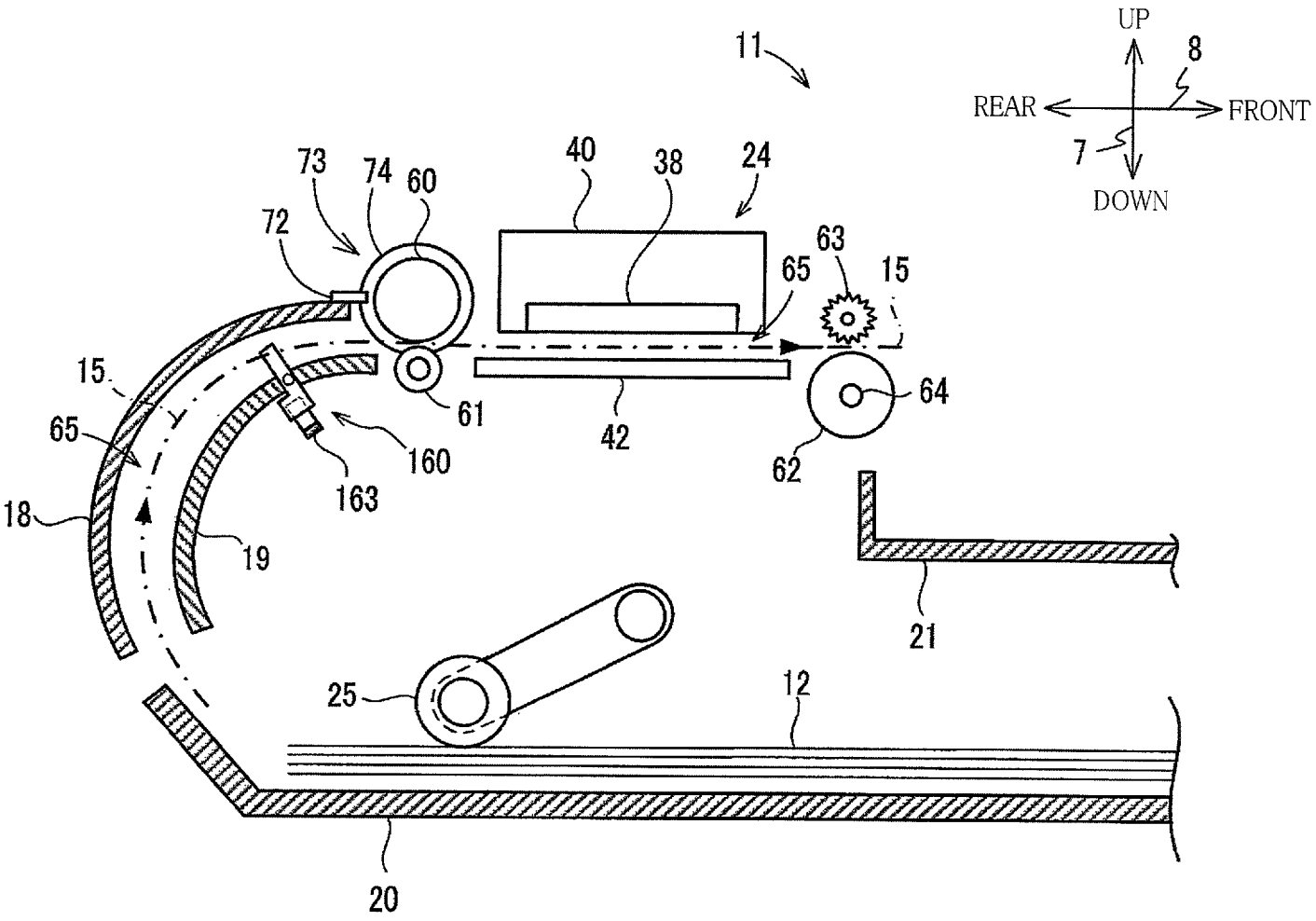
FIG. 2 is an elevational view in vertical cross section schematically illustrating an internal structure of a printing unit.

As illustrated in FIG. 2, a supply roller 25 is disposed above the supply tray 20. The supply roller 25 is contactable with an upper surface of the sheet 12 supported on the supply tray 20. The supply roller 25 is rotated forward (forwardly) by reverse-rotation driving power generated by a conveying motor 71 (see FIGS. 3A, 3B, and 4). It is noted that the forward rotation of the supply roller 25 is rotation in a direction in which to supply the sheet 12 to a conveyance path 65 and convey the sheet 12 in a conveying direction 15 through the conveyance path 65. That is, the supply roller 25 is rotated in a clockwise direction during its forward rotation when the printing unit 11 is viewed as illustrated in FIG. 2.

In the printing unit 11, the conveyance path 65 extends from a rear end portion of the supply tray 20. The conveyance path 65 includes a curved portion and a straight portion. The conveyance path 65 is defined by an outer guide member 18 and an inner guide member 19 which are opposed to each other at a predetermined distance therebetween. The sheet 12 supported on the supply tray 20 is conveyed through the curved portion from its lower side toward its upper side so as to make a U-turn. The sheet 12 is then conveyed to a recording device 24 through the straight portion. The recording device 24 performs image recording on the sheet 12. After the image recording, the sheet 12 is conveyed through the straight portion and discharged onto the output tray 21. That is, the sheet 12 is conveyed in the conveying direction 15 indicated by one-dot chain-line arrow in FIG. 2.

Conveying Roller Pair and Output Roller Pair

As illustrated in FIG. 2, a conveying roller pair and an output roller pair are provided on the conveyance path 65. The conveying roller pair is located upstream of the recording device 24 in the conveying direction 15 and includes a conveying roller 60 and a pinch roller 61. The output roller pair is located downstream of the recording device 24 in the conveying direction 15 and includes an output roller 62 and a spur 63. Each roller pair is rotated while nipping the sheet to convey the sheet 12.

The conveying roller 60 contacts a recording surface of the sheet 12 conveyed along the conveyance path 65. The pinch roller 61 is opposed to the conveying roller 60. The pinch roller 61 is rotated with rotation of the conveying roller 60. The conveying roller 60 and the pinch roller 61 nip the sheet 12 therebetween and convey the sheet 12 in the conveying direction 15.

The conveying roller 60 is rotated forward by driving power generated by the conveying motor 71 driven and rotated in a first rotational direction (e.g., forward rotation). The forward rotation of the conveying roller 60 is rotation in a direction in which to convey the sheet 12 in the conveying direction 15. That is, the conveying roller 60 is rotated in a counterclockwise direction during its forward rotation when the printing unit 11 is viewed as illustrated in FIG. 2. The forward rotation of the conveying roller pair hereinafter indicates rotation of the conveying roller 60 in the counterclockwise direction in FIG. 2.

The conveying roller 60 is rotated reverse (reversely) by driving power generated by the conveying motor 71 driven and rotated in a second rotational direction reverse to the first direction (e.g., reverse rotation). The reverse rotation of the conveying roller 60 is rotation in a direction in which to convey the sheet 12 in a direction reverse to the conveying direction 15. That is, the conveying roller 60 is rotated in a clockwise direction during its reverse rotation when the printing unit 11 is viewed as illustrated in FIG. 2. The reverse rotation of the conveying roller pair hereinafter indicates rotation of the conveying roller 60 in the clockwise direction in FIG. 2.

The output roller pair is provided downstream of the recording device 24 in the conveying direction 15. The output roller 62 contacts a back surface (opposite from the recording surface) of the sheet 12 conveyed along the conveyance path 65. The output roller 62 is fitted on and rotated together with a shaft 64 which is rotated by driving power generated by the conveying motor 71. The spur 63 is opposed to the output roller 62 and rotated with rotation of the output roller 62. The output roller 62 and the spur 63 nip the sheet 12 therebetween and convey the sheet 12 in the conveying direction 15.

The output roller 62 is rotated forward by driving power generated by the conveying motor 71 rotated forward. The forward rotation of the output roller 62 is rotation in a direction in which to convey the sheet 12 in the conveying direction 15. That is, the output roller 62 is rotated in a clockwise direction during its forward rotation when the printing unit 11 is viewed as illustrated in FIG. 2. The forward rotation of the output roller pair hereinafter indicates rotation of the output roller 62 in the clockwise direction in FIG. 2. As described below in detail, the output roller 62 does not receive the driving power transmitted from the conveying motor 71 rotated reverse.

Recording Device 24

As illustrated in FIG. 2, the recording device 24 is provided downstream of the conveying roller 60 in the conveying direction 15 and upstream of the output roller 62 in the conveying direction 15. A platen 42 is provided under the recording device 24 so as to be opposed to the recording device 24. The platen 42 supports the sheet 12 conveyed through the conveyance path 65. The recording device 24 employs a well-known ink jet ejection method to record an image on the sheet 12 supported on the platen 42. The recording device 24 includes: a recording head 38 having a multiplicity of nozzles through which the recording head 38 ejects ink droplets onto the sheet 12; and a carriage 40 for holding the recording head 38 mounted thereon.

The carriage 40 is supported by, e.g., a frame of the printing unit 11 so as to be reciprocable in the moving direction perpendicular to the conveying direction 15. It is noted that the moving direction corresponds to the right and left direction 9. The carriage 40 is coupled to a carriage motor 53 (see FIG. 4) by a well-known belt mechanism. Upon receipt of driving power transmitted from the carriage motor 53, the carriage 40 is reciprocated in moving direction (which corresponds to the right and left direction 9). This reciprocation of the carriage 40 is performed in a state in which the sheet 12 is supported on the platen 42. The recording head 38 ejects ink droplets from the nozzles during the reciprocation of the carriage 40. As a result, an image is formed on the sheet 12 supported on the platen 42.

Register Sensor 160

As illustrated in FIG. 2, a register sensor 160 is provided upstream of the conveying roller 60 in the conveying direction 15. The register sensor 160 includes an optical sensor 163. The optical sensor 163 outputs a sense signal in accordance with the presence or absence of the sheet 12 at a sensing position which is located upstream of the conveying roller 60. For example, when the sheet 12 is absent at the sensing position, the optical sensor 163 of the register sensor 160 outputs a low level signal to a controller 130 which will be described below. When the sheet 12 is present at the sensing position, on the other hand, the optical sensor 163 of the register sensor 160 outputs a high level signal to the controller 130.

Rotary Encoder 73

As illustrated in FIG. 2, an encoder disc 74 having slits arranged radially is mounted on the conveying roller 60. An optical sensor 72 is fixed to, e.g., the frame of the printing unit 11 such that the encoder disc 74 is interposed between portions of the optical sensor 72 in a thickness direction of the encoder disc 74 (i.e., in a direction perpendicular to the sheet surface of FIG. 2). During rotation of the encoder disc 74, the slits and non-slit portions of the encoder disc 74 alternately pass through the optical sensor 72. The optical sensor 72 outputs pulse signals to the controller 130 in response to passages of the slits and the non-slit portions. It is noted that the encoder disc 74 and the optical sensor 72 constitute a rotary encoder 73.

Power Transmission Mechanism

Figure 3B:
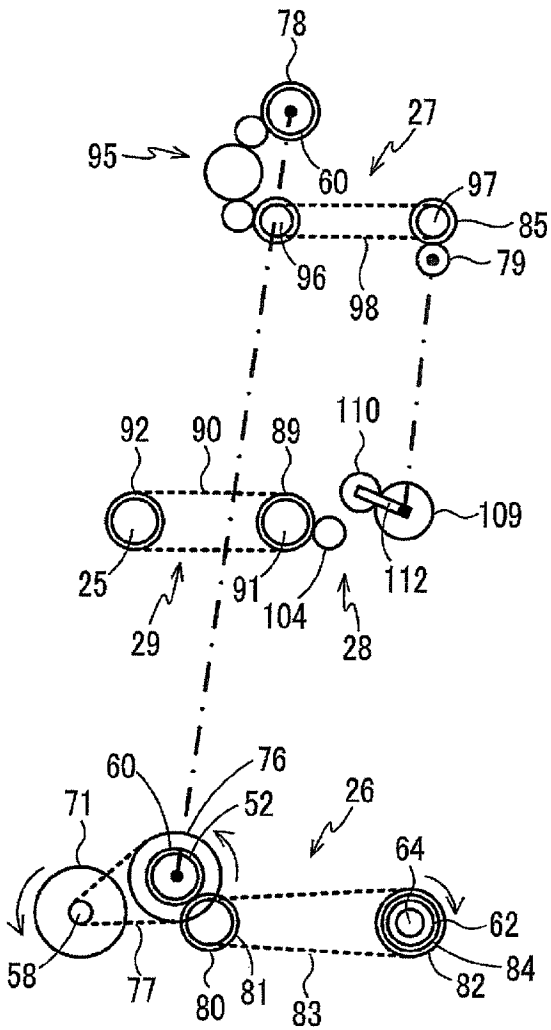
FIGS. 3A and 3B are schematic views each illustrating a transmission relationship between a conveying motor and rollers.
Figure 3A:
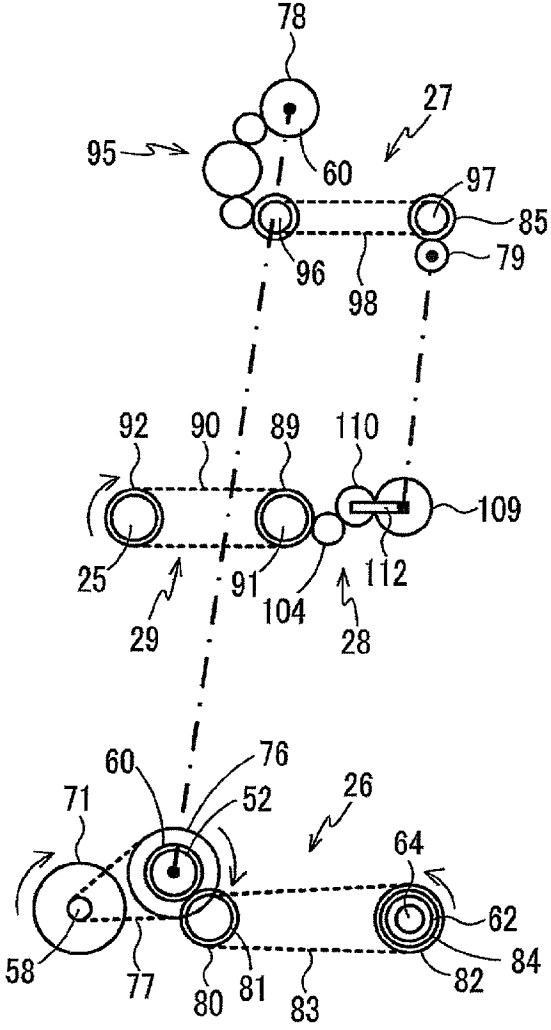

There will be next explained, with reference to FIGS. 3A and 3B, a power transmission mechanism for transmitting driving power from the conveying motor 71 to rollers. The power transmission mechanism includes a pulley 76, a motor pulley 58, an endless belt 77, a first power transmitter 26, a second power transmitter 27, a third power transmitter 28, and a supply power transmitter 29.

As illustrated in FIGS. 3A and 3B, the pulley 76 is mounted on the conveying roller 60 to the left of the conveyance path 65. The motor pulley 58 is mounted on a rotation shaft of the conveying motor 71. The endless belt 77 is looped over the pulley 76 and the motor pulley 58. As a result, the rotation driving power of the conveying motor 71 is transmitted to the conveying roller 60. Specifically, the conveying roller 60 is rotated forward by forward rotation of the conveying motor 71 (or by rotation thereof in the first rotational direction) and is rotated reverse by reverse rotation of the conveying motor 71 (or by rotation thereof in the second rotational direction).

First Power Transmitter 26

As illustrated in FIGS. 3A and 3B, the first power transmitter 26 includes a left gear 52, a lower gear 80, a first pulley 81, a second pulley 82, and an endless belt 83. The left gear 52 is mounted on the conveying roller 60. The lower gear 80 is meshed with a lower portion of the left gear 52. The first pulley 81 is rotated coaxially and integrally with the lower gear 80. With these constructions, the first pulley 81 is rotated in conjunction with rotation of the conveying roller 60. The second pulley 82 is mounted on the shaft 64 of the output roller 62. The endless belt 83 is looped over the first pulley 81 and the second pulley 82.

It is noted that a well-known one-way clutch 84 (specifically, a needle clutch) is provided inside the second pulley 82. That is, the second pulley 82 is mounted on the shaft 64, with the one-way clutch 84 interposed therebetween. With this construction, the first power transmitter 26 transmits the rotation driving power of the conveying motor 71 rotated forward, to the output roller 62 and does not transmit the rotation driving power of the conveying motor 71 rotated reverse, to the output roller 62. That is, the output roller 62 is rotated forward by the forward-rotation driving power transmitted from the conveying motor 71 by the first power transmitter 26, but the reverse rotation of the conveying motor 71 does not cause reverse rotation of the output roller 62 because no power is transmitted to the output roller 62.

Second Power Transmitter 27

As illustrated in FIGS. 3A and 3B, the second power transmitter 27, disposed to the right of the conveyance path 65, includes a right gear 78, a plurality of intermediate gears 95 meshed with each other, pulleys 96, 97, an endless belt 98, a gear 85, and a shaft 79.

The plurality of intermediate gears 95 are arranged in a state in which these gears are meshed with each other. The pulley 96 is rotated coaxially and integrally with one of the intermediate gears 95 which is disposed on the most downstream side in a path through which the driving power is transmitted. The endless belt 98 is looped over the pulley 96 and the pulley 97. The gear 85 is rotated coaxially and integrally with the pulley 97 and meshed with gears of the shaft 79.

Third Power Transmitter 28

As illustrated in FIGS. 3A and 3B, the third power transmitter 28 includes a sun gear 109, a pendulum gear 110, and an intermediate gear 104.

The sun gear 109 is rotated coaxially and integrally with the shaft 79. One end of an arm 112 is mounted on a thrust face of the sun gear 109. As a result, the arm 112 is rotated coaxially with the sun gear 109. The pendulum gear 110 is rotatably supported by the other end of the arm 112. The pendulum gear 110 is rotated while supported by the arm 112 and is revolved in a rotational direction of the sun gear 109 while meshed with the sun gear 109. The pendulum gear 110 is meshable with the intermediate gear 104.

When the conveying motor 71 is rotated forward (or is rotated in the first rotational direction), the conveying roller 60 and the right gear 78 are rotated in the counterclockwise direction, and the sun gear 109 is rotated in the clockwise direction. With these rotations, the pendulum gear 110 being rotated in the counterclockwise direction is revolved around the sun gear 109 in the clockwise direction and moved off the intermediate gear 104 (see FIG. 3B). As a result, the forward-rotation driving power of the conveying motor 71 is not transmitted to the intermediate gear 104.

When the conveying motor 71 is rotated reverse (or is rotated in the second rotational direction), the conveying roller 60 and the right gear 78 are rotated in the clockwise direction, and the sun gear 109 is rotated in the counterclockwise direction. With these rotations, the pendulum gear 110 being rotated in the clockwise direction is revolved around the sun gear 109 in the counterclockwise direction and meshed with the intermediate gear 104 (see FIG. 3A). As a result, the reverse-rotation driving power of the conveying motor 71 is transmitted to the intermediate gear 104.

Supply Power Transmitter 29

As illustrated in FIGS. 3A and 3B, the supply power transmitter 29 includes an intermediate gear 89, an endless belt 90, a pulley 91, and a roller pulley 92.

The intermediate gear 89 is meshed with the intermediate gear 104. The pulley 91 is rotated coaxially and integrally with the intermediate gear 89. The endless belt 90 is looped over the pulley 91 and the roller pulley 92. The roller pulley 92 is rotated coaxially and integrally with the supply roller 25.

There will be next explained power transmission by the supply power transmitter 29 with reference to FIGS. 3A and 3B. When the conveying motor 71 is rotated reverse (or is rotated in the second rotational direction), the conveying roller 60 and the right gear 78 are rotated in the clockwise direction. When the right gear 78 is rotated in the clockwise direction, the intermediate gear 89 is rotated in the counterclockwise direction, which rotates the pulley 91 and the roller pulley 92 in the clockwise direction.

When the pulley 91 and the roller pulley 92 are rotated in the clockwise direction, the supply roller 25, which is rotated integrally with the roller pulley 92, is also rotated in the clockwise direction. As a result, the sheet 12 placed on the supply tray 20 and contacting the supply roller 25, i.e., the uppermost one of the sheets 12 is supplied to the conveying roller 60.

When the conveying motor 71 is rotated forward (or is rotated in the first rotational direction), as described above, the pendulum gear 110 is moved off the intermediate gear 104. That is, the supply power transmitter 29 dose not transmit the forward-rotation driving power of the conveying motor 71 to the supply roller 25.

Controller 130

Figure 4:
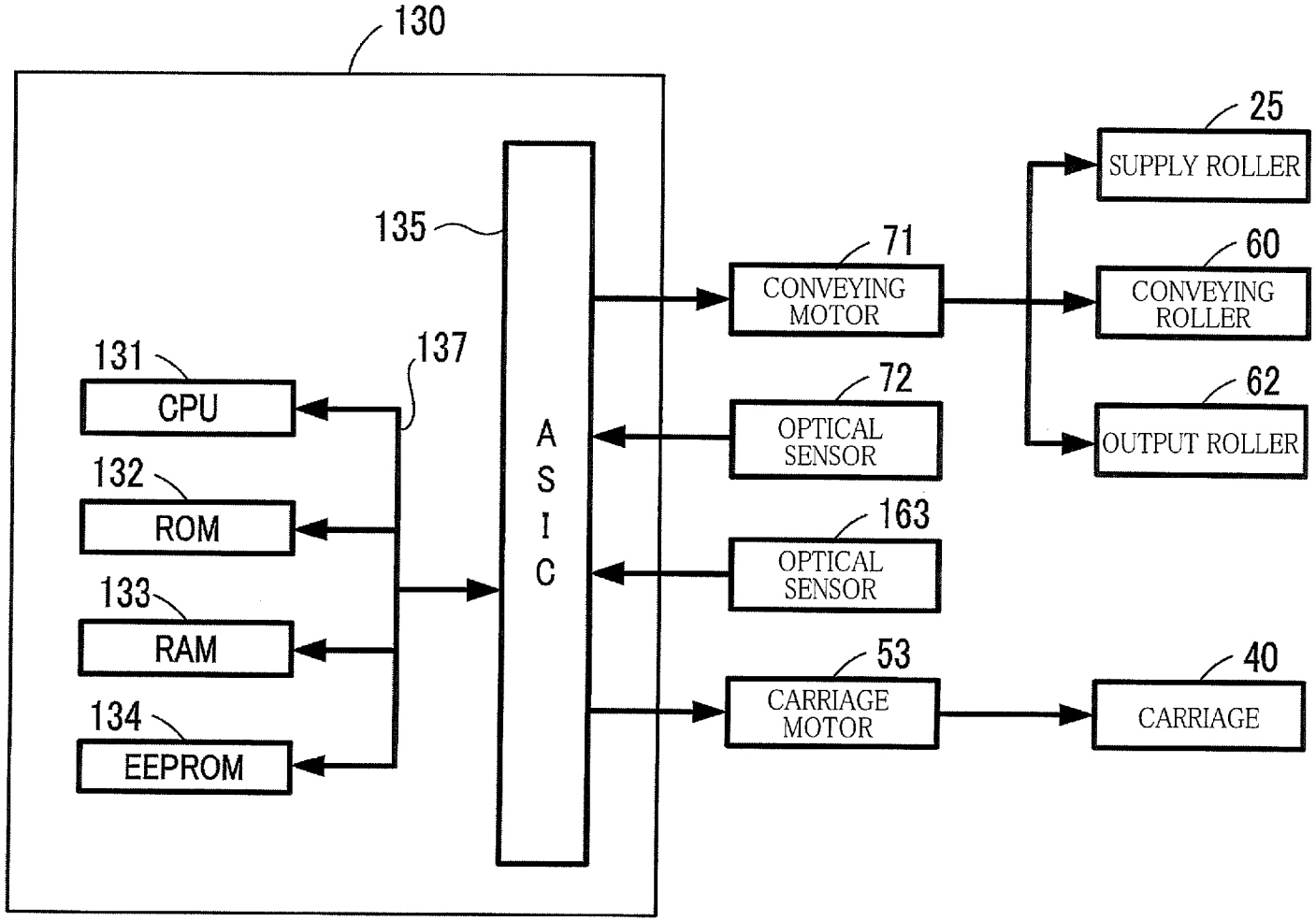
FIG. 4 is a block diagram illustrating a configuration of a controller.

As illustrated in FIG. 4, the controller 130 controls overall operations of the MFP 10. For example, the controller 130 controls driving of the conveying motor 71 to rotate the rollers. Also, the controller 130 controls a carriage drive motor 53 to move the carriage 40. The controller 130 includes a CPU 131, a ROM 132, a RAM 133, an EEPROM 134, an ASIC 135, and an internal bus 137 for connecting these devices to each other.

The ROM 132 stores various instructions which are computer (e.g., the CPU 131) readable instructions and data for the CPU 131 to control various operations. This various instructions include specific instructions. The specific instructions, read and executed by the CPU 131 of the controller 130, cause the controller 130 to control the MFP 10 (or printing unit 11) to perform specific operations according to the flow charts illustrated in FIGS. 5 and 6. The specific operations include the "image recording" operation including conveyance processings and recording processings which will be explained below. Further the specific operations include a supply processing and a pre-discharge supply processing which will be explained below. The RAM 133 is used as a storage area for temporarily storing, e.g., data and signals used when the CPU 131 executes the programs. The EEPROM 134 is for storing settings, flags, and other similar data which should be kept after the MFP 10 is turned off.

The conveying motor 71 and the carriage motor 53 are electrically connected to the ASIC 135. The ASIC 135 acquires drive signals for rotating the motors, from the CPU 131 and sends the motors drive currents related to the drive signals. Each motor is rotated forward or reverse at a predetermined rotational speed by the drive current that is output from the ASIC 135.

Specifically, the ASIC 135 acquires, from the CPU 131, a drive signal for driving the conveying motor 71 forward or reverse. The ASIC 135 outputs a drive current related to the acquired drive signal, to the corresponding conveying motor 71 to execute at least the supply processing, the conveyance processing, and the pre-discharge supply processing. The supply processing is a processing for rotating the conveying motor 71 reverse to cause the supply roller 25 to supply the sheet 12. The conveyance processing is a processing for rotating the conveying motor 71 forward to cause at least one of the conveying roller 60 and the output roller 62 to convey the sheet 12 in the conveying direction 15. The pre-discharge supply processing is a processing for executing the supply processing to start supplying the next sheet 12 to the conveyance path 65 before completion of a recording processing for the sheet 12 whose trailing edge in the conveying direction 15 has been determined to pass through the conveying roller 60.

Also, the ASIC 135 acquires a drive signal for rotating the carriage motor 53, from the CPU 131. The ASIC 135 outputs a drive current related to the acquired drive signal, to the carriage motor 53 to execute at least the recording processing. The recording processing is a processing for controlling the carriage motor 53 to move the carriage 40 in the moving direction and controlling the recording head 38 to perform image recording on the sheet 12 while rotating the carriage motor 53 to move the carriage 40 when the conveyance processing is being or to be stopped.

The optical sensor 72 of the rotary encoder 73 and an optical sensor 163 of the register sensor 160 are electrically connected to the ASIC 135. The controller 130 detects a rotation amount of each of the rollers 60, 62, 25 based on the pulse signal acquired from the optical sensor 72. The controller 130 executes a position determination processing for determining positions of leading and trailing edges of the sheet 12 based on the sense signal output from the optical sensor 163.

Control of Image Recording by Controller 130

Figure 5:
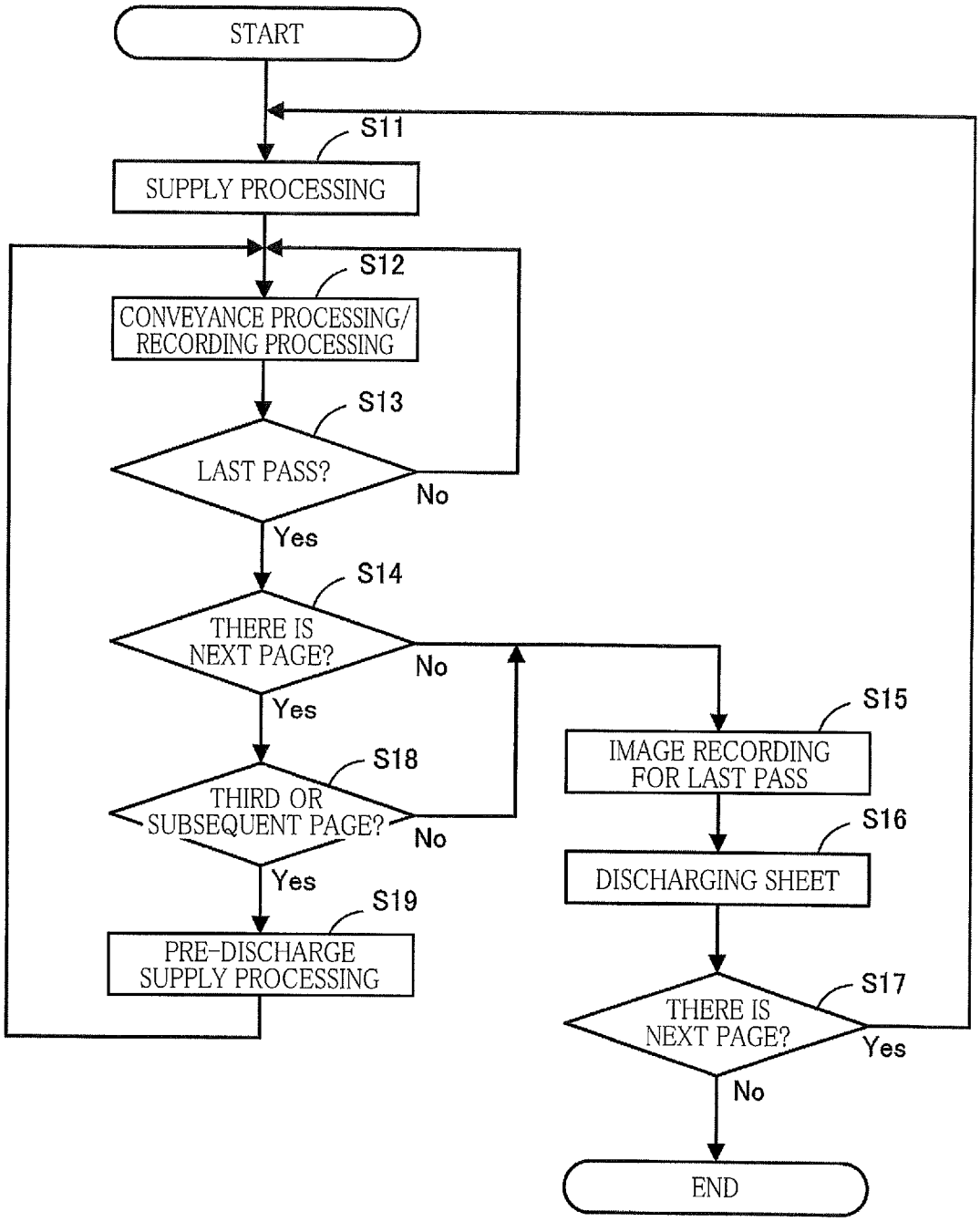
FIG. 5 is a flow chart illustrating a procedure of image recording.

There will be next explained control of operations of the printing unit 11 by the controller 130 in the case where image recording is performed on a single side of each of a plurality of sheets 12. As illustrated in FIG. 5, the controller 130 begins image recording of the printing unit 11 on the sheet 12 in response to an image recording command which is input from a user to the MFP 10.

At S11, the controller 130 executes a supply processing. In the supply processing (at S11), the controller 130 rotates the conveying motor 71 reverse (or in the second rotational direction) to rotate the supply roller 25 forward, which supplies the sheet 12 from the supply tray 20 to the conveyance path 65.

While keeping the reverse rotation of the conveying motor 71, the controller 130 counts the number of pulse signals output from the optical sensor 72 of the rotary encoder 73, after the sense signal output from the optical sensor 163 of the register sensor 160 is changed from the low level signal to the high level signal. When the number of counted pulse signals reaches a value larger than or equal to a threshold value, the controller 130 stops the reverse rotation of the conveying motor 71. This threshold value corresponds to a distance from the register sensor 160 to the conveying roller 60 (more specifically, a distance from the register sensor 160 to a point at which the sheet 12 is nipped between the conveying roller 60 and the pinch roller 61). As a result, the leading edge of the sheet 12 supplied to the conveyance path 65 reaches the conveying roller 60.

The controller 130 rotates the conveying motor 71 forward (or in the first rotational direction). This forward rotation rotates the conveying roller 60 and the output roller 62 forward. It is noted that the supply roller 25 is at rest without rotating even when the conveying motor 71 is rotated forward. The forward rotation of the conveying roller 60 conveys a leading edge portion of the sheet 12 onto the platen 42. That is, a leading-edge positioning operation is performed for the sheet 12 (the conveyance processing).

When the leading edge of the sheet 12 reaches a position just under the recording head 38 at which image recording is to be started, the controller 130 stops the conveying motor 71. After the stop of the conveying motor 71, the controller 130 drives the carriage motor 53 to move the carriage 40 in the moving direction and at the same time controls the recording head 38 to perform the image recording by ejecting the ink onto the sheet 12 supported on the platen 42 (the recording processing). When the recording processing is finished for one pass, the controller 130 stops the carriage motor 53 and rotates the conveying motor 71 forward to convey the sheet 12 in the conveying direction 15 by an amount corresponding to a single line feed (the conveyance processing). The conveyance processing (i.e., intermittent conveyance) and the recording processing described above are repeated until the recording processing is executed for the last pass, whereby an image is recorded on the sheet 12 (S12, S13).

When the recording processing is for the last pass (S13: Yes), and there is no print data for the next page (S14: No), the controller 130 executes processings at S15 and S16. The controller 130 at S15 controls the recording head 38 and carriage 40 to perform the recording processing for the last pass. The controller 130 at S16 rotates the conveying motor 71 forward and causes the conveying roller 60 and the output roller 62 to convey the sheet 12 in the conveying direction 15 and discharge the sheet 12 from the conveyance path 65 onto the output tray 21.

When the recording processing is for the last pass (S13: Yes), and there is print data for the next page (S14: Yes), and the next page is a second page (S18: No), the controller 130 at S15 executes the recording processing for the last pass and at S16 causes the conveying roller 60 and the output roller 62 to discharge the sheet 12 from the conveyance path 65 onto the output tray 21. After the discharge of the sheet 12, when there is print data for the next page (S17: Yes), the controller 130 executes the processing at S11 at which the controller 130 rotates the conveying motor 71 reverse to rotate the supply roller 25 forward to supply the next sheet 12 from the supply tray 20 to the conveyance path 65.

Figure 7A:
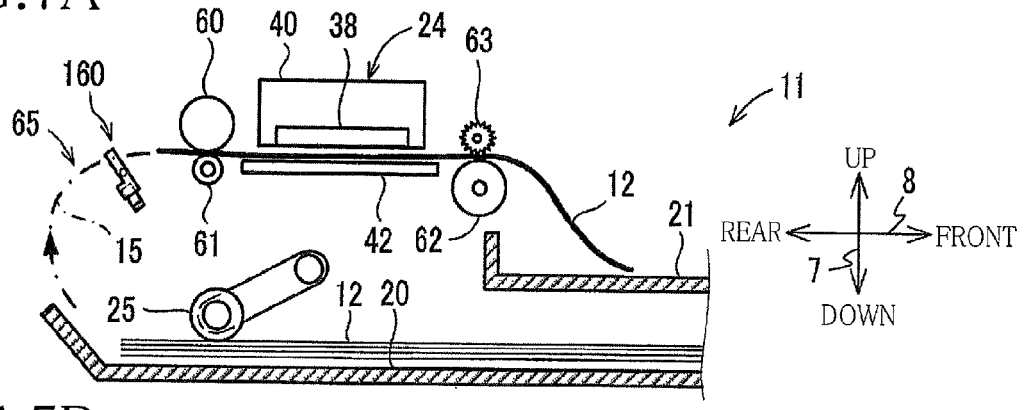
FIGS. 7A-7D are elevational views in vertical cross section each schematically illustrating positions of sheets in the printing unit.
Figure 7B:
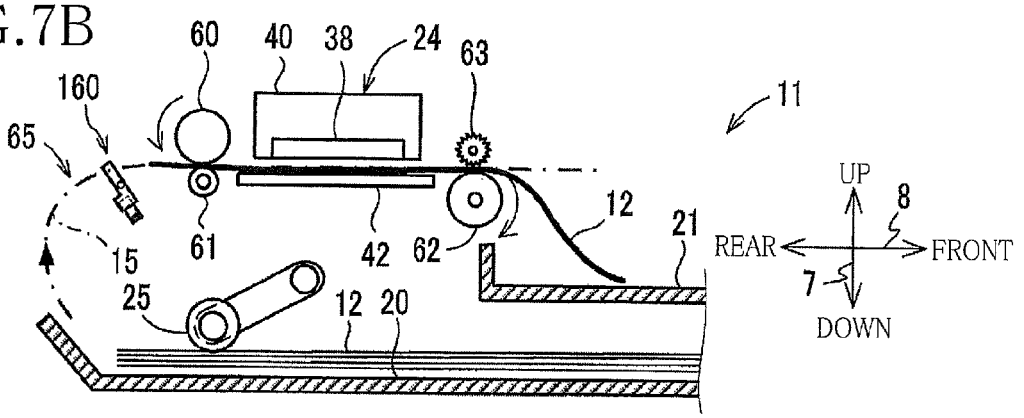

The controller 130 repeats the conveyance processing and the recording processing (S12) for the sheet 12 for the second page in the same manner as described above (see FIGS. 7A and 7B). FIG. 7A illustrates a state of the printing unit 11 and the sheet 12 in the recording processing for a pass just before the last pass. FIG. 7B illustrates a state of the printing unit 11 and the sheet 12 in the conveyance processing in which the sheet 12 is conveyed to the last pass. When the recording processing for the sheet 12 for the second page is for the last pass (S13: Yes), and there is print data for the next page (S14: Yes), and the next page is a third page (S18: Yes), the controller 130 at S19 executes the pre-discharge supply processing.

Figure 6:
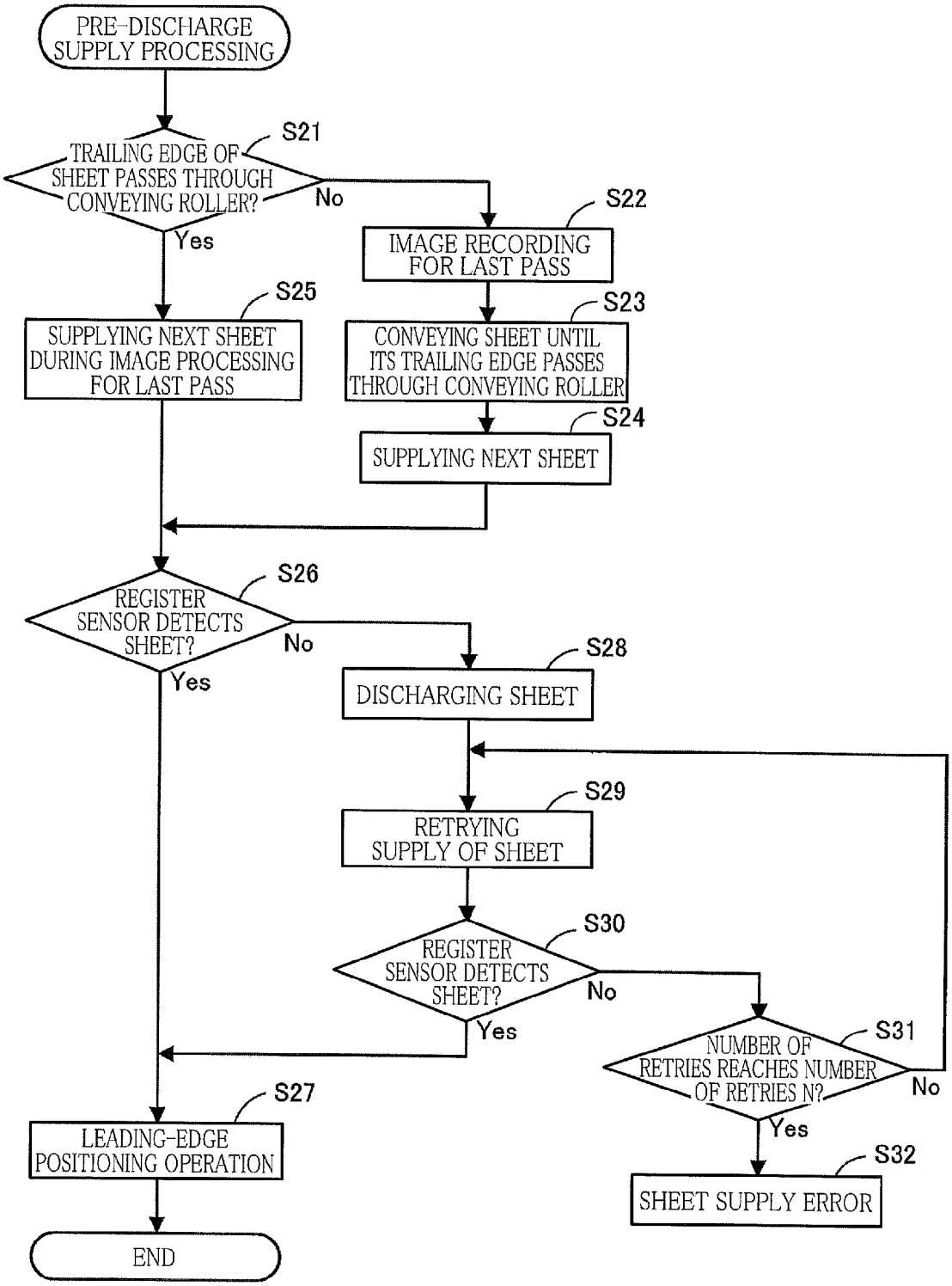
FIG. 6 is a flow chart illustrating a procedure of a pre-discharge supply processing.

There will be next explained the pre-discharge supply processing at S19 with reference to FIG. 6. As illustrated in FIG. 6, when the recording processing for the sheet 12 for the second page is for the last pass, and when the count of the number of pulse signals output from the rotary encoder 73 (the number of high level signals) has not exceeded the above-described threshold value after the sense signal output from the register sensor 160 is changed from the high level signal to the low level signal (S21: No), the controller 130 executes processings at S22 and S23. This threshold value corresponds to the distance from the register sensor 160 to the conveying roller 60 (more specifically, the distance from the register sensor 160 to the point at which the sheet 12 is nipped between the conveying roller 60 and the pinch roller 61). The controller 130 at S22 executes the recording processing for the last pass. The controller 130 at S23 rotates the conveying motor 71 forward until the count exceeds the threshold value. As a result, even when the trailing edge of the sheet 12 for the second page has not passed through the conveying roller 60 at the completion of the recording processing for the last pass, the sheet P is conveyed in the conveying direction 15 until the trailing edge of the sheet 12 passes through the conveying roller 60.

The controller 130 at S24 rotates the conveying motor 71 reverse to rotate the supply roller 25 forward and the conveying roller 60 reverse. It is noted that the output roller 62 is at rest. The forward rotation of the supply roller 25 supplies the sheet 12 for the third page from the supply tray 20 to the conveyance path 65. The trailing edge of the sheet 12 for the second page has already passed through the conveying roller 60 in this state. Thus, the sheet 12 for the second page is not conveyed in the direction reverse to the conveying direction 15 even when the conveying roller 60 is rotated reverse. Also, since the output roller 62 is at rest, the sheet 12 for the second page is not conveyed in the conveying direction 15, either.

When the recording processing for the sheet 12 for the second page is for the last pass, and the count exceeds the threshold value (S21: Yes), the controller 130 executes a processing at S25. It is noted that the trailing edge of the sheet 12 for the second page is in this state located at a position at which the trailing edge has passed through the conveying roller 60 and has not passed through the output roller 62, i.e., a position just under the recording head 38.

The controller 130 at S25 controls the recording head 38 and the carriage 40 to execute the recording processing for the last pass and rotates the conveying motor 71 reverse either. Specifically, the controller 130 starts rotating the conveying motor 71 reverse after the completion of acceleration of the carriage motor 53 for moving the carriage 40 in the recording processing. The reverse rotation of the conveying motor 71 rotates the supply roller 25 forward and the conveying roller 60 reverse (see FIG. 7C). It is noted that the output roller 62 is at rest. The forward rotation of the supply roller 25 supplies the sheet 12 for the third page from the supply tray 20 to the conveyance path 65 (S25). The trailing edge of the sheet 12 for the second page has already passed through the conveying roller 60 in this state. Thus, the sheet 12 for the second page is not conveyed in the direction reverse to the conveying direction 15 even when the conveying roller 60 is rotated reverse. Also, since the output roller 62 is at rest, the sheet 12 for the second page is not conveyed in the conveying direction 15, either. Accordingly, the recording processing for the last pass is performed on the sheet 12 for the second page in a state in which the conveyance is stopped.

Figure 7C:
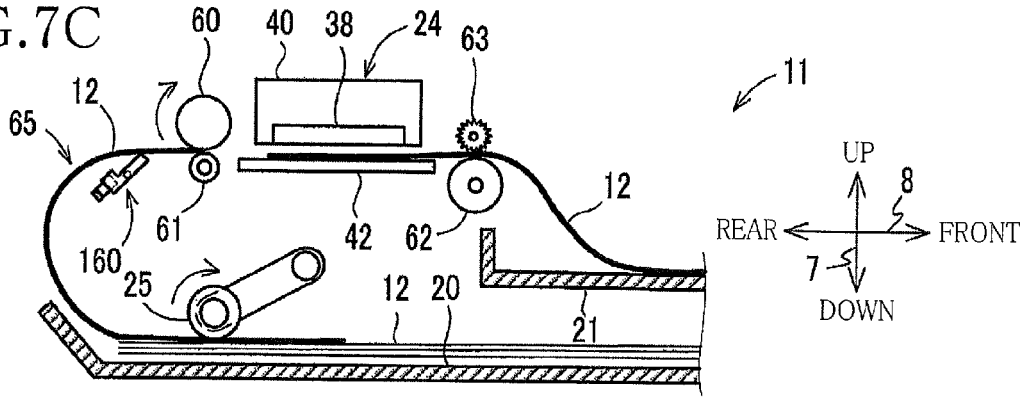

While keeping the reverse rotation of the conveying motor 71, the controller 130 counts the number of pulse signals (the number of high level signals) output from the rotary encoder 73, after the sense signal output from the register sensor 160 is changed from the low level signal to the high level signal. When the number of counted pulse signals exceeds or reaches the threshold value, the controller 130 stops the reverse rotation of the conveying motor 71. As a result, as illustrated in FIG. 7C, the leading edge of the sheet 12 for the third page reaches the conveying roller 60.

Figure 7D:
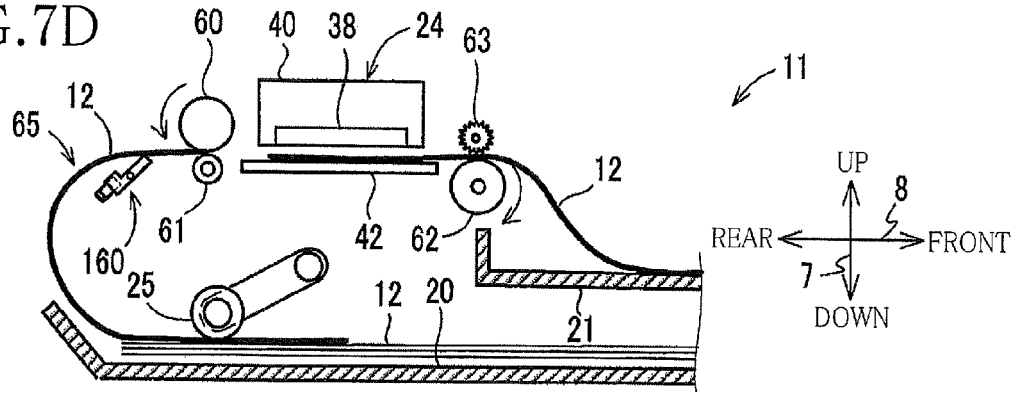

The controller 130 at S27 rotates the conveying motor 71 forward to rotate the conveying roller 60 and the output roller 62 forward (see FIG. 7D). It is noted that the supply roller 25 is at rest without rotating even when the conveying motor 71 is rotated forward. The forward rotation of the conveying roller 60 conveys a leading edge portion of the sheet 12 for the third page onto the platen 42. That is, the leading-edge positioning operation is performed for the sheet 12 for the third page. Also, the forward rotation of the output roller 62 conveys the sheet 12 for the second page in the conveying direction 15.

When the sense signal output from the register sensor 160 is not changed from the low level signal to the high level signal even though the conveying motor 71 is kept rotated reverse for a particular time (S26: No), the controller 130 at S28 rotates the conveying motor 71 forward. The forward rotation of the conveying motor 71 rotates the conveying roller 60 and the output roller 62 forward to discharge the sheet 12 for the second page onto the output tray 21. The controller 130 at S29 rotates the conveying motor 71 reverse to rotate the supply roller 25 forward and the conveying roller 60 reverse. That is, the controller 130 retries to supply the sheet 12 for the third page.

When the sense signal output from the register sensor 160 is changed from the low level signal to the high level signal in the state in which the conveying motor 71 is kept rotated reverse (S30: Yes), the controller 130 at S27 executes the processing to perform the leading-edge positioning operation for the sheet 12 for the third page in the same manner as described above.

When the sense signal output from the register sensor 160 is not changed from the low level signal to the high level signal even though the conveying motor 71 is kept rotated reverse for the particular time in the retry (S30: No), the controller 130 increments the number of retries by one, and the controller 130 executes a processing at S31. When the incremented number of retries has not exceeded the number of retries N (S31: No), the controller 130 at S29 retries the sheet supply again. When the incremented number of retries exceeds the number of retries N (S31: Yes), the controller 130 at S32 provides an error notification by, for example, displaying a sheet supply error on a display device of the MFP 10 or making an error sound.

As illustrated in FIG. 5, when the leading-edge positioning operation for the sheet 12 for the third page is finished by the pre-discharge supply processing (S19), the controller 130 controls the recording device 24 to perform image recording by repeating the conveyance processing and the recording processing for the sheet 12 for the third page in the same manner as described above until the recording processing is executed for the last pass (S12, S13, and FIGS. 8A-8D).

Figure 8A:
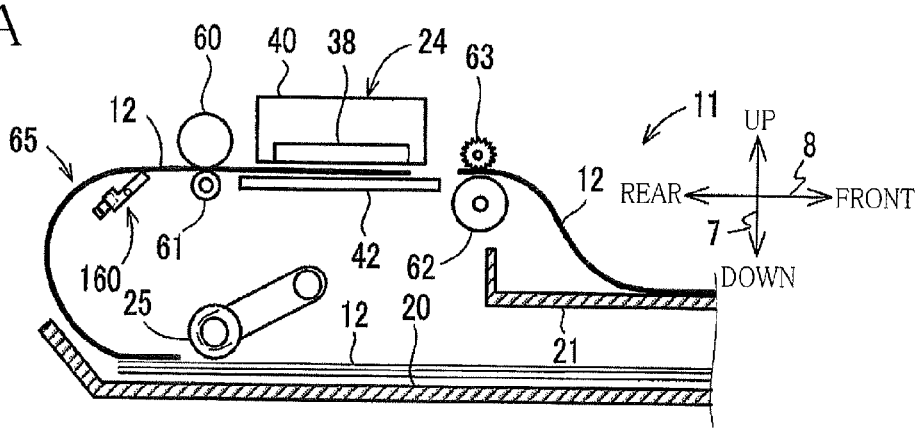
FIGS. 8A-8D are elevational views in vertical cross section each schematically illustrating positions of sheets in the printing unit.
Figure 8B:
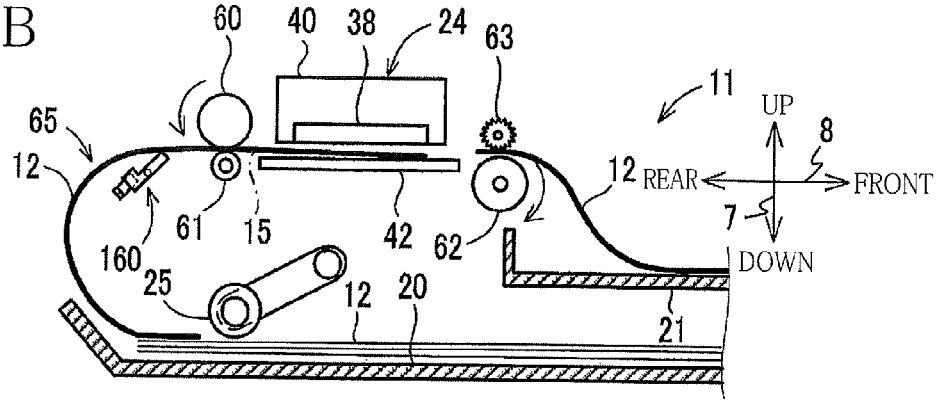
Figure 8C:
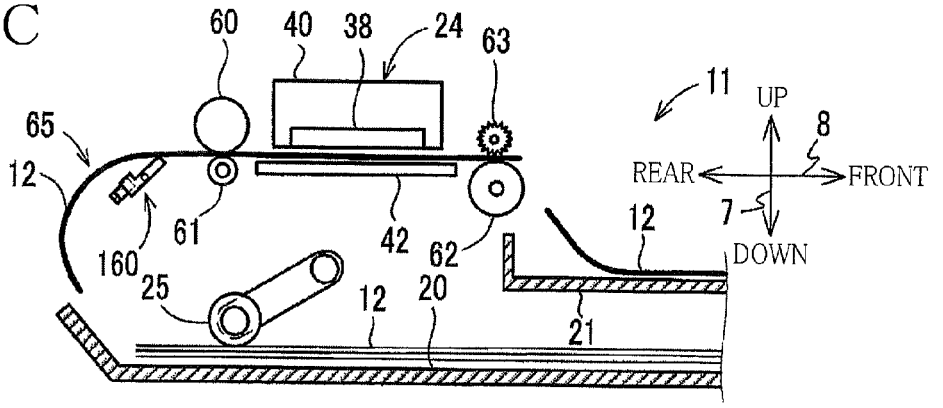
Figure 8D:
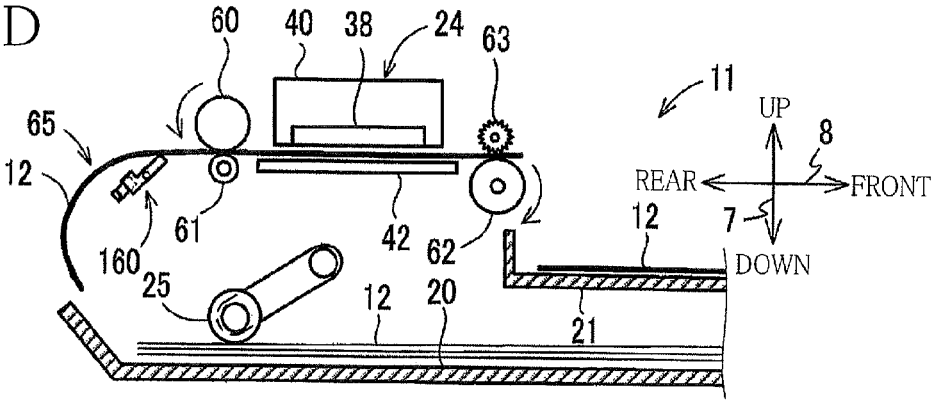

FIG. 8A illustrates a state of the printing unit 11 and the sheets 12 in the recording processing for the first pass for the sheet 12 for the third page. FIG. 8B illustrates a state of the printing unit 11 and the sheets 12 in the conveyance processing for the sheets 12 for the second and third pages just after the recording processing for the first pass for the sheet 12 for the third page. FIG. 8C illustrates a state of the printing unit 11 and the sheets 12 in the recording processing for the second pass for the sheet 12 for the third page. FIG. 8D illustrates a state of the printing unit 11 and the sheets 12 in the conveyance processing for the sheet 12 for the third page just after the recording processing for the second pass for the sheet 12 for the third page.

In the conveyance processing (intermittent conveyance) for the sheet 12 for the third page, the sheet 12 for the second page is also intermittently conveyed in the conveying direction 15 (see FIG. 8B) and discharged from the conveyance path 65 onto the output tray 21 (see FIGS. 8C and 8D).

When the image recording for the sheet 12 for the third page is for the last pass (S13: Yes), and there is print data for the next page (S14: Yes), and the next page is a fourth page (S18: Yes), the controller 130 executes the pre-discharge supply processing (S19) in the same manner as described above. When there is no print data for the next page (S14: No), on the other hand, the controller 130 at S15 executes the recording processing for the last pass (S15). And the controller 130 at S16 rotates the conveying motor 71 forward to and causes the conveying roller 60 and the output roller 62 to convey the sheet 12 for the third page in the conveying direction 15 and to discharge the sheet 12 for the third page from the conveyance path 65 onto the output tray 21 (S16).

Effects

In image recording for a plurality of the sheets 12, the sheet 12 for the third page starts to be supplied to the conveyance path 65 after the trailing edge of the sheet 12 for the second page passes through the conveying roller 60 and before the completion of the recording processing for the sheet 12 for the second page, for example. Thus, the conveyance or recording for the sheet 12 for the second page and the supply of the sheet 12 for the third page overlap each other timewise at least partly, resulting in a reduced length of time required for image recording for a plurality of the sheets 12.

The controller 130 executes the pre-discharge supply processing during movement of the carriage 40 in the recording processing. Accordingly, the image recording for the sheet 12 for the second page and the supply of the sheet 12 for the third page overlap each other timewise at least partly.

The controller 130 executes the pre-discharge supply processing during movement of the carriage 40 along the last pass in the image recording for the sheet 12 for the second page, for example. In this processing, the rotational direction of the conveying motor 71 is not changed in repetitions of the recording processing and the conveyance processing for the sheet 12 for the second page, resulting in a stable quality of image recording.

The controller 130 starts reverse rotation of the conveying motor 71 in the pre-discharge supply processing after the completion of the acceleration for moving the carriage 40 using the carriage motor 53. This configuration can avoid an overlap between a peak of electric power required for the carriage motor 53 and a peak of electric power required for the conveying motor 71.

When the controller 130 determines that the leading edge of the sheet 12 for the third page reaches the conveying roller 60 in the position determination processing after the completion of the recording processing for the last pass in the image recording for the sheet 12 for the second page, for example, the controller 130 controls the recording device 24 to intermittently convey the sheet 12 for the second page and the sheet 12 for the third page at the same time in the conveyance processing. As a result, the sheet 12 for the second page is discharged from the conveyance path 65 while the sheet 12 for the third page is being intermittently conveyed.

When the particular time has passed from the execution of the pre-discharge supply processing after the completion of the recording processing for the last pass in the image recording for the sheet 12 for the second page, for example, the controller determines whether or not the leading edge of the sheet 12 for the third page has reached the conveying roller 60 in the position determination processing. When the controller does not determine that the leading edge of the sheet 12 for the third page has reached the conveying roller 60 in the position determination processing even when the particular time has passed from the execution of the pre-discharge supply processing, the controller 130 executes the supply processing for the sheet 12 for the third page after the sheet 12 for the second page is discharged from the conveyance path 65. With this configuration, in the event of, e.g., malfunction in supply of the sheet 12 for the third page, the sheet 12 for the second page can be discharged smoothly.

In response to receiving a recording instruction for image recording on three or more sheets, the controller 130 controls the rollers to discharge the sheet 12 for the first page from the conveyance path 65 and then executes the supply processing to supply the sheet 12 for the second page. With this processing, the sheet 12 for the first page is rapidly discharged from the conveyance path 65 after the completion of image recording.

Modifications

In the above-described embodiment, the controller 130 executes the pre-discharge supply processing during movement of the carriage 40 along the last pass in the recording processing for the sheet 12 for the second page, for example. However, the controller 130 may execute the pre-discharge supply processing after the completion of the conveyance processing for a pass preceding (just before) the last pass in the image recording on the sheet 12 for the second page and before moving the carriage 40, for example. The controller 130 may execute the pre-discharge supply processing when the carriage 40 is not moved in a period after the completion of the conveyance processing for the pass just before the last pass in the recording processing on the sheet 12 for the second page and before execution of the conveyance processing after the conveyance processing for the last pass. Even when the pre-discharge supply processing is executed at each of these timings, the rotational direction of the conveying motor 71 is not changed in the conveyance processing executed during the recording processing on the sheet 12 for the second page, resulting in a stable quality of the image recording.

Figure 9A:
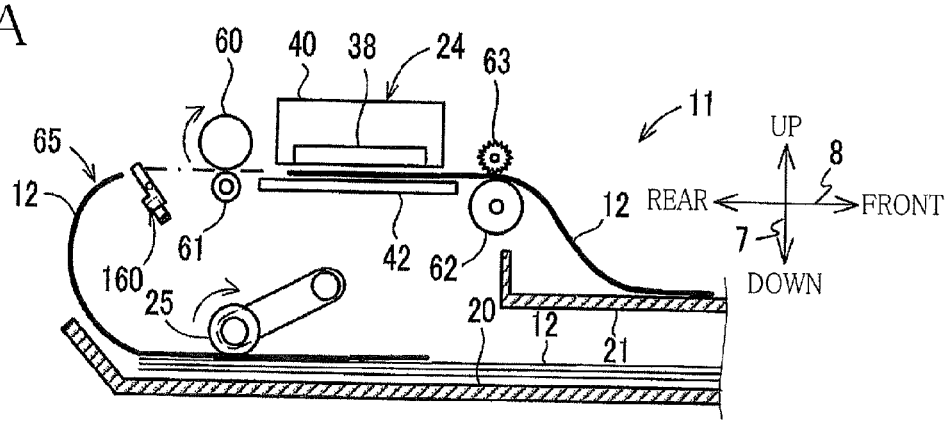
FIGS. 9A-9D are elevational views in vertical cross section each schematically illustrating positions of sheets in the printing unit.
Figure 9B:
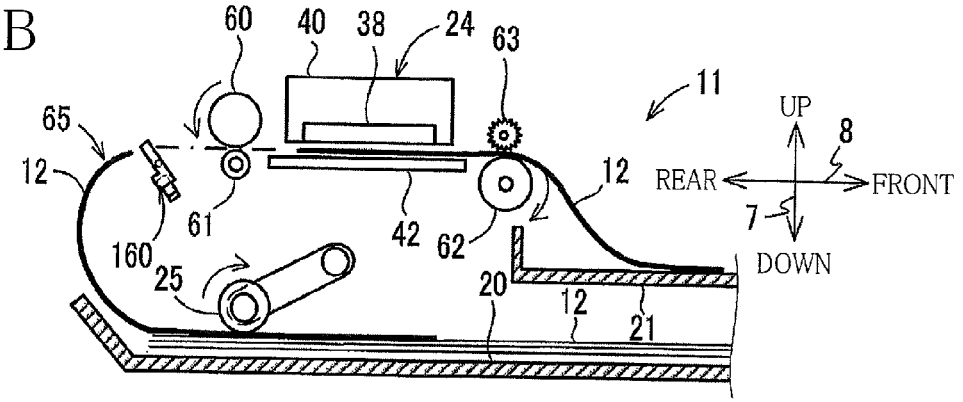
Figure 9C:
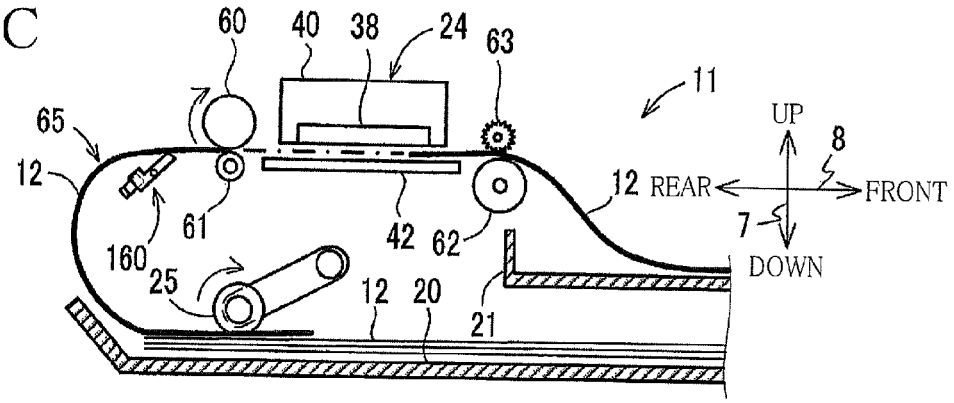
Figure 9D:
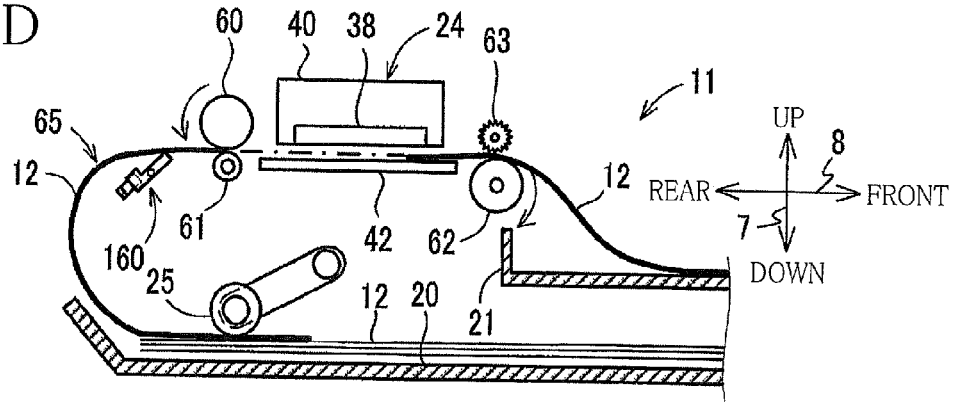

The controller 130 may rotate the conveying motor 71 reverse to execute the pre-discharge supply processing during the recording processing for the pass just before the last pass in the image recording on the sheet 12 for the second page, for example. In this configuration, the trailing edge of the sheet 12 during the recording processing for the pass just before the last pass needs to pass through the conveying roller 60. As a result, as illustrated in FIG. 9A, the sheet 12 for the third page is supplied from the supply tray 20 to the conveyance path 65. After the recording processing for the pass just before the last pass, the controller 130 rotates the conveying motor 71 forward. The forward rotation of the conveying motor 71 rotates the conveying roller 60 and the output roller 62 forward (see FIG. 9B) to convey the sheet 12 for the second page by an amount corresponding to a single line feed toward a position for the recording processing for the last pass. The controller 130 then rotates the conveying motor 71 reverse to rotate the supply roller 25 forward and the conveying roller 60 reverse. As a result, the leading edge of the sheet 12 for the third page reaches the conveying roller 60. During the reverse rotation of the conveying motor 71, the controller 130 executes the recording processing for the last pass for the sheet 12 for the second page (see FIG. 9C). After the recording processing for the last pass, the controller 130 rotates the conveying motor 71 forward. The forward rotation of the conveying motor 71 rotates the conveying roller 60 and the output roller 62 forward to discharge the sheet 12 for the second page and perform the leading-edge positioning operation for the sheet 12 for the third page (see FIG. 9D).

The controller 130 may determine the positions of the leading and trailing edges of the sheet 12 with a configuration without the register sensor 160 and the rotary encoder 73. Specifically, the controller 130 may determine the positions of the leading and trailing edges of the sheet 12 based on a rotation amount of the supply roller 25 and/or an optical sensor mounted on the carriage 40.

What is claimed is:

1. An image recording apparatus, comprising:

a supply roller configured to supply a sheet to a conveyance path;

a conveying roller rotatable forwardly to convey the sheet supplied by the supply roller in a conveying direction and the conveying roller being rotatable reversely;

an output roller rotatable forwardly to convey the sheet conveyed by the conveying roller in the conveying direction;

a carriage provided with a recording head configured to perform image recording on the sheet, the carriage being disposed between the conveying roller and the output roller in the conveying direction and configured to be moved in a moving direction intersecting the conveying direction;

a motor rotatable in a first rotational direction and in a second rotational direction reverse to the first rotational direction;

a transmission mechanism configured to:

cause driving power generated by the motor during rotation thereof in the first rotational direction, to be transmitted not to the supply roller, transmitted to the conveying roller to rotate the conveying roller forwardly, and transmitted to the output roller to rotate the output roller forwardly; and cause driving power generated by the motor during rotation thereof in the second rotational direction, to be transmitted to the supply roller to rotate the supply roller, transmitted to the conveying roller to rotate the conveying roller reversely, and transmitted not to the output roller; and a controller configured to execute:

a supply processing in which the controller controls the motor to rotate in the second rotational direction to cause the supply roller to supply the sheet;

a conveyance processing in which the controller controls the motor to rotate in the first rotational direction to cause at least one of the conveying roller and the output roller to convey the sheet in the conveying direction;

a recording processing in which the controller controls the carriage to move in the moving direction and controls the recording head to perform the image recording during moving the carriage, while the conveyance processing is not being executed;

controlling the carriage, the recording head, and the motor to perform an image recording operation by executing the conveyance processing and the recording processing alternately; and a pre-discharge supply processing as the supply processing in the image recording operation at a point in time in a period starting from a timing when a trailing edge position of a first sheet passes through the conveying roller and ending at a timing when all the recording processings on the first sheet are completed, the controller being configured to, in the pre-discharge supply processing, control the supply roller to supply a second sheet to the conveyance path, following the first sheet being stopped from being conveyed, in a state in which the trailing edge of the first sheet is positioned between the conveying roller and the output roller in the conveying direction, in the conveyance processing.

2. The image recording apparatus according to claim 1, wherein the controller is configured to execute the pre-discharge supply processing during movement of the carriage in the recording processing for the first sheet in the image recording operation.

3. The image recording apparatus according to claim 1, wherein the controller is configured to execute the pre-discharge supply processing during movement of the carriage in a last recording processing of a plurality of the recording processings for the first sheet in the image recording operation.

4. The image recording apparatus according to claim 1, wherein the controller is configured to start rotating the motor in the pre-discharge supply processing after completion of acceleration for moving the carriage.

5. The image recording apparatus according to claim 1, wherein the controller is configured to execute the pre-discharge supply processing after completion of the conveyance processing just before a last recording processing of a plurality of the recording processings for the first sheet in the image recording operation.

6. The image recording apparatus according to claim 1, wherein the controller is configured to execute the pre-discharge supply processing at a point in time in a period starting from a timing when the conveyance processing executed just before a last recording processing of a plurality of the recording processings for the first sheet is executed, and ending at a timing when the conveyance processing executed just after the last recording processing is started in the image recording operation.

7. The image recording apparatus according to claim 1, wherein the controller is configured to execute the conveyance processing to control the motor to intermittently rotate in the first rotational direction to cause the output roller to convey the first sheet and cause the coveying roller to convey the second sheet simultaneously when a leading edge position of the second sheet reaches the conveying roller after completion of a last recording processing of a plurality of the recording processings for the first sheet in the image recording operation.

8. The image recording apparatus according to claim 7, wherein the controller is configured to execute the conveyance processing to control the motor to intermittently rotate in the first rotational direction to cause the output roller to convey the first sheet and cause the conveying roller to convey the second sheet simultaneously when the leading edge position of the second sheet reaches the conveying roller at a point in time in a period starting from a timing when the last recording processing executed for the first sheet is completed and ending at a timing when the conveyance processing executed just after the last recording processing is started.

9. The image recording apparatus according to claim 1, wherein the controller is configured to execute the supply processing after the first sheet is discharged from the conveyance path in the conveyance processing, when a leading edge position of the second sheet does not reach the conveying roller even when a particular time passes from execution of the pre-discharge supply processing after completion of the last recording processing of the plurality of recording processings for the first sheet in the image recording operation.

10. The image recording apparatus according to claim 1, wherein the controller is configured, in response to a recording instruction for image recording on successive at least three sheets, to:

execute the supply processing to supply a second-supplied sheet of the successive at least three sheets as the first sheet to the conveyance path after executing the conveyance processing to discharge a first-supplied sheet of the successive at least three sheets from the conveyance path; and thereafter execute the pre-discharge supply processing to supply a third-supplied sheet of the successive at least three sheets as the second sheet to the conveyance path at a point in time in a period starting from a timing when the trailing edge position of the first sheet passes through the conveying roller and ending at a timing when all the recording processings on the first sheet are completed.

11. The image recording apparatus according to claim 1, further comprising:

an output device configured to output a sense signal related to a presence of the sheet at a sensing position located upstream of the conveying roller in the conveying direction; and a rotary encoder configured to output a pulse signal in response to rotation of the conveying roller, wherein the controller is configured to execute a position determination processing in which the controller determines the trailing edge position of the sheet based on the sense signal output from the output device and the pulse signal output from the rotary encoder.

12. A method of controlling an image recording apparatus, the image recording apparatus comprising: a motor rotatable in a first rotational direction and in a second rotational direction reverse to the first rotational direction; a supply roller configured not to supply the sheet by rotation of the motor in the first rotational direction and configured to supply the sheet by rotation of the motor in the second rotational direction; a conveying roller rotatable forwardly by the rotation of the motor in the first rotational direction to convey the sheet in a conveying direction and rotatable reversely by the rotation of the motor in the second rotational direction; an output roller rotatble forwardly by the rotation of the motor in the first rotational direction to convey the sheet in the conveying direction and configured not to convey the sheet in the conveying direction by the rotation of the motor in the second rotational direction; and a carriage provided with a recording head configured to perform image recording on the sheet, the carriage being disposed between the conveying roller and the output roller in the conveying direction and configured to be moved in a moving direction intersecting the conveying direction;

the method comprising:

a supply processing for controlling the motor to rotate in the second rotational direction to cause the supply roller to supply the sheet;

a conveyance processing for controlling the motor to rotate in the first rotational direction to cause at least one of the conveying roller and the output roller to convey the sheet in the conveying direction;

a recording processing for controlling the carriage to move in the moving direction and controlling the recording head to perform the image recording during moving the carriage, while the conveyance processing is not being executed;

controlling the carriage, the recording head, and the motor to perform an image recording operation by executing the conveyance processing and the recording processing alternately; and a pre-discharge supply processing as the supply processing in the image recording operation at a point in time in a period starting from a timing when a trailing edge position of a first sheet passes through the conveying roller and ending at a timing when all the recording processings on the first sheet are completed, the pre-discharge supply processing being for controlling the supply roller to supply a second sheet to the conveyance path, following the first sheet being stopped from being conveyed, in a state in which the trailing edge of the first sheet is positioned between the conveying roller and the output roller in the conveying direction, in the conveyance processing.

13. A non-transitory storage medium storing a plurality of instructions executable by a computer of an image recording apparatus, the image recording apparatus comprising: a motor rotatable in a first rotational direction and in a second rotational direction reverse to the first rotational direction; a supply roller configured not to supply the sheet by rotation of the motor in the first rotational direction and configured to supply the sheet by rotation of the motor in the second rotational direction; a conveying roller rotatable forwardly by the rotation of the motor in the first rotational direction to convey the sheet in a conveying direction and rotatable reversely by the rotation of the motor in the second rotational direction; an output roller rotatble forwardly by the rotation of the motor in the first rotational direction to convey the sheet in the conveying direction and configured not to convey the sheet in the conveying direction by the rotation of the motor in the second rotational direction; and a carriage provided with a recording head configured to perform image recording on the sheet, the carriage being disposed between the conveying roller and the output roller in the conveying direction and configured to be moved in a moving direction intersecting the conveying direction, the plurality of instructions, when executed, causing the computer to execute:

a supply processing for controlling the motor to rotate in the second rotational direction to cause the supply roller to supply the sheet;

a conveyance processing for controlling the motor to rotate in the first rotational direction to cause at least one of the conveying roller and the output roller to convey the sheet in the conveying direction;

a recording processing for controlling the carriage to move in the moving direction and controlling the recording head to perform the image recording during moving the carriage, while the conveyance processing is not being executed;

controlling the carriage, the recording head, and the motor to perform an image recording operation by executing the conveyance processing and the recording processing alternately; and a pre-discharge supply processing as the supply processing in the image recording operation at a point in time in a period starting from a timing when a trailing edge position of a first sheet passes through the conveying roller and ending at a timing when all the recording processings on the first sheet are completed, the pre-discharge supply processing being for controlling the supply roller to supply a second sheet to the conveyance path, following the first sheet being stopped from being conveyed, in a state in which the trailing edge of the first sheet is positioned between the conveying roller and the output roller in the conveying direction, in the conveyance processing.

* * * * *